United States Patent [19]

Zeitlin et al.

[11] Patent Number: 4,694,678

[45] Date of Patent: Sep. 22, 1987

[54] TIE-RODS FABRICATED OF COMPOSITE MATERIALS FOR FORGING PRESSES

[75] Inventors: Alexander Zeitlin, White Plains; Adam Zandel, Forest Hills, both of N.Y.

[73] Assignee: Press Technology Corporation, White Plains, N.Y.

[21] Appl. No.: 820,019

[22] Filed: Jan. 21, 1986

[51] Int. Cl.[4] ..... B21J 13/04; B21D 37/12

[52] U.S. Cl. ..... 72/455; 100/214; 74/581

[58] Field of Search ..... 72/455, 456, 462, 478; 100/214, 282, 283, 269 R; 74/579 R, 581, 579 E

[56] References Cited

U.S. PATENT DOCUMENTS

| | | | |
|---|---|---|---|
| 158,571 | 1/1875 | Chandler | 74/581 |
| 1,770,624 | 7/1930 | Noble | 74/581 |
| 2,903,909 | 9/1959 | Engel | 74/581 |
| 3,262,335 | 7/1966 | Heinlein et al. | 74/581 |
| 3,512,356 | 5/1970 | Krekeler | 59/84 |
| 4,569,248 | 2/1986 | Hug | 74/581 |

FOREIGN PATENT DOCUMENTS

| | | | |
|---|---|---|---|
| 719403 | 3/1942 | Fed. Rep. of Germany | 100/214 |

*Primary Examiner*—Robert L. Spruill
*Assistant Examiner*—David B. Jones
*Attorney, Agent, or Firm*—Ostrolenk, Faber, Gerb & Soffen

[57] ABSTRACT

Each tie-rod bar or beam from which tie-rod assemblies for large forging presses are assembled is constructed of a middle section made of a lower yield strength alloy steel to which end sections made of steel alloy having comparatively higher yield strengths are welded. A link pin hole is formed in each end section for receiving a link bolt intended for securing a plurality of the tie-rod bars to one another and/or to the frame of the forging press. The end section may be slightly wider to more easily withstand the larger stresses developed there during operations of the press. In one preferred adaptation, the material of the middle section is designed for a minimum of 45,000 psi and the end section for a minimum of 80,000 psi.

7 Claims, 3 Drawing Figures

70

TIE-RODS FABRICATED OF COMPOSITE MATERIALS FOR FORGING PRESSES

BACKGROUND OF THE INVENTION

This invention relates to large, up to 500 kiloton, forging presses and, more particularly, is directed to a novel tie-rod beam construction from which a frame for the forging press may be assembled.

The present application is closely related to the subject matter described in patent application Ser. No. 821,790 entitled "A FORGING PRESS WITH ADJUSTABLE DAYLIGHT AND WITH YOKE DESIGN FOR ATTACHING TIE-RODS TO CROSSHEADS" which is commonly assigned with the present application. The subject matter thereof is incorporated herein by reference.

As is known and by way of background, forging presses are used for shaping metal slabs into end products of desired shape by pressing the metal slab between a pair of dies to give it its shape.

Structurally, the forging press includes a very large steel frame which surrounds a stationary bridge or platform on which a workpiece is placed. In a particular type of a forging press known as a pull-down press, the frame is movable up and down relative to the stationary bridge. The frame is actually a massive structure which includes a horizontally extending upper crosshead which is disposed transversely to the stationary bridge, a lower crosshead below the bridge and a pair of tie-rod assemblies on either side of the bridge for connecting the upper crosshead and the lower crosshead to one another. The upper crosshead of the frame is used for squeezing the workpiece between the frame and the stationary bridge. Very powerful hydraulic jacks located underneath the bridge are operable to push the lower crosshead of the frame downwardly, thereby producing enormous compressive forces on the workpiece which is located on the bridge directly underneath the upper crosshead of the frame.

The tie-rod assemblies which connect the upper and lower crossheads to one another are in a mechanical stress environment too large to make it practical to construct an entire tie-rod assembly as a single unitary component for several reasons. For example, the mechanical stresses are so large that the weight of each of the two tie-rod assemblies exceeds two thousand tons. Available steel industry facilities cannot produce a single large steel beam or bar which will handle such a load. Moreover, it is highly impractical to ship very large and heavy structures. Furthermore, the length of a tie-rod is dictated by requirements of the particular forging press and flexibility in tie-rod lengths is desired. Other reasons include repairability and maintenance of the forging press.

In consequence of the above considerations, it has been known to construct a tie-rod—or for that matter a crosshead—as laminated assemblies constructed of superposed, rolled steel plates or beams with a combined mechanical strength which meets the requirements of the press.

Particularly in relation to the design of up to 500 kiloton forging presses, there is a clear and present need for improved tie-rod plates or beams which are better able to handle the very large forces of the press while maintaining weight and cost at a minimum.

SUMMARY OF THE INVENTION

It is, therefore, an object of the present invention to provide an improved tie-rod plate construction particularly for use in up to 500 kiloton presses.

It is another object of the present invention to provide a tie-rod plate construction which can be manufactued with existing steel industry facilities.

It is yet another object of the present invention to provide a tie-rod plate construction which is capable of withstanding larger operational stresses.

The foregoing and other objects of the present invention are realized with an improved tie-rod plate for use in assembling a tie-rod assembly.

A single tie-rod plate in accordance with the present invention includes an elongated, generally flat steel bar which includes a middle section constructed of a metal having a predetermined yield strength and first and second end sections connected respectively to longitudinally opposite ends of the middle section. The end sections are constructed of a steel alloy having a yield strength which is greater than the yield strength of the middle section for handling the larger stresses which develop in the end sections. The end sections are formed with pinholes therein which permit the tie-rod plate to be connected in the frame of the forging press.

Preferably, the middle section of the plate will be made of a less costly alloy, for instance, an alloy known as ASTM 572, Grade 45 or 50, with a yield strength of a minimum of 45,000 psi. The more heavily stressed end sections are preferably constructed of an alloy having a minimum of 80,000 psi yield strength. An exemplary alloy of this type is ASTM 543-79a, Class 3, steel alloy which is heat-treated to obtain the desired yield strength. The end sections are preferably welded to the middle section. The weld seam will have a strength which is slightly above the strength of the middle section due to the fusion of some of the alloying elements from the end sections into the weld metal.

Other features, advantages and uses of the present invention will become apparent from the following description of a preferred embodiment of the present invention which is described in relation to the appended drawings.

DETAILED DESCRIPTION OF THE INVENTION

Figure 1:
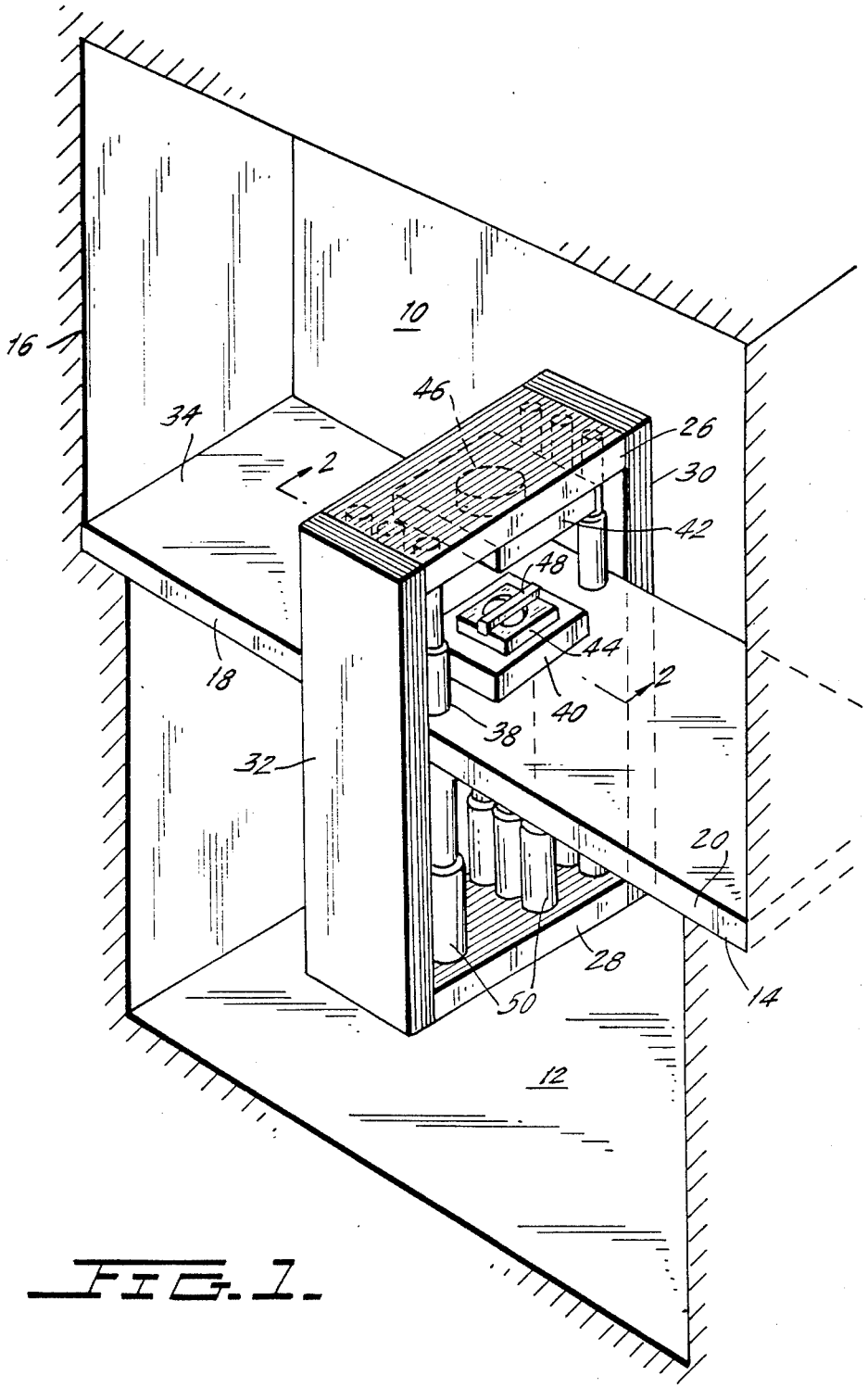
FIG. 1 is a schematically drawn perspective of a forging press.
Figure 2:
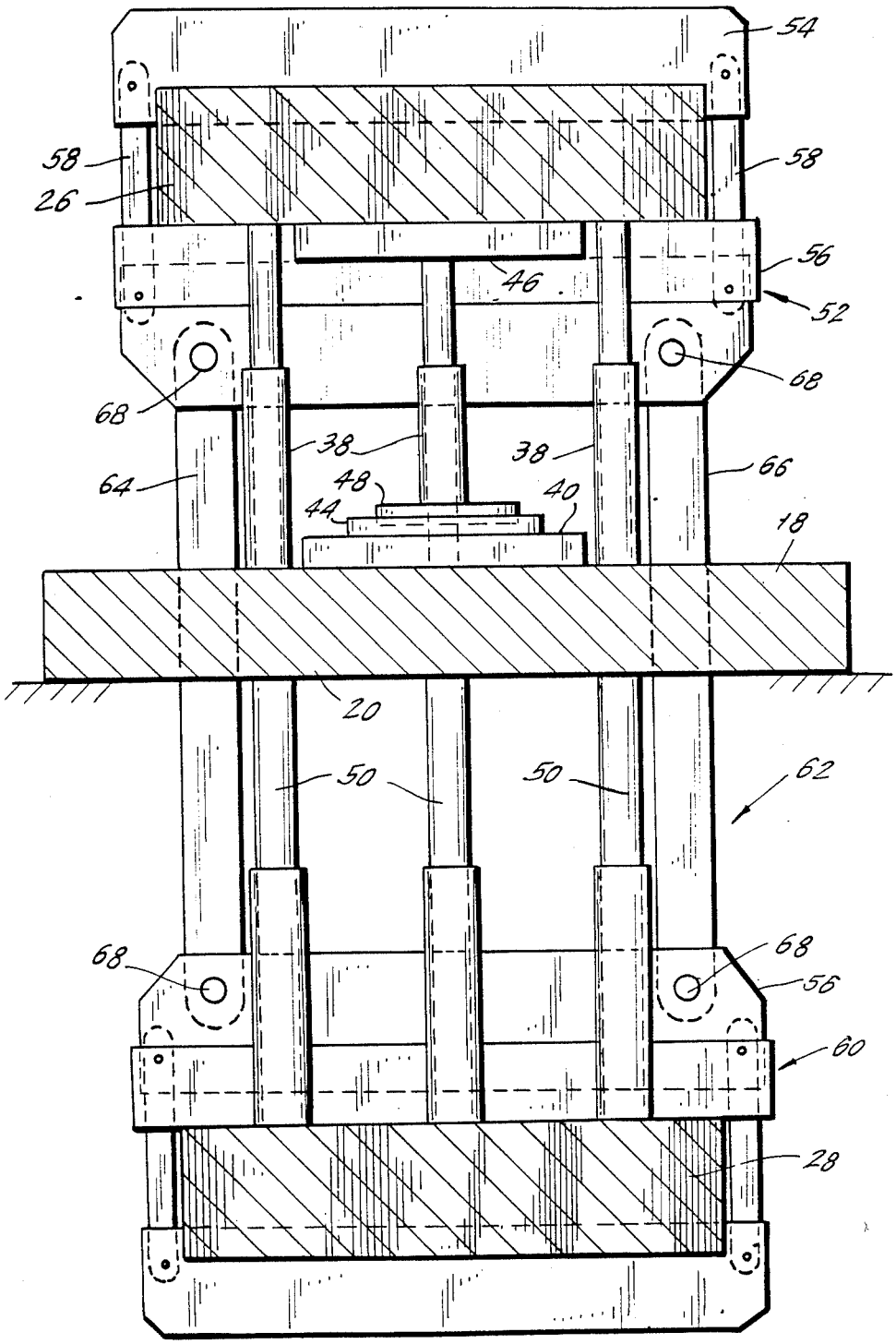
FIG. 2 is a section through FIG. 1 along lines 2—2.
Figure 3:
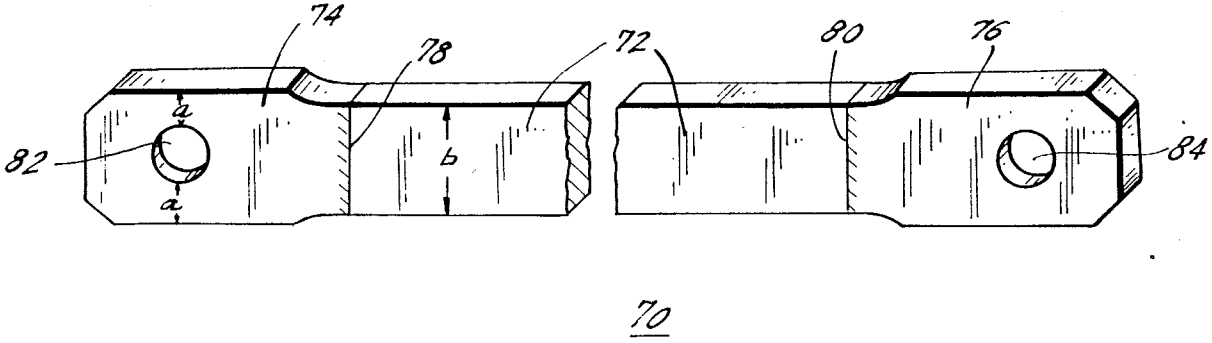
FIG. 3 illustrates a preferred embodiment of a tie-rod bar or plate from which a tie-rod assembly of the present invention is constructed.

FIGS. 1–2 illustrate schematically the major components of a particular forging press known as a pull-down forging press. It is important to note that the perspective of FIG. 1 is strictly schematical and does not correspond to an actual forging press. Similarly, FIG. 2 is only a schematic representation of a press, although it contains more detail. FIGS. 1–2 are provided solely for the purpose of describing the general environment to which the present invention, illustrated in FIG. 3, is applicable.

Referring first to FIG. 1, the forging press 10 there illustrated is housed in a building structure for a forging press having a foundation pit 12 below ground level 14 and a main building 16 above ground level. A bridge 18 extends across foundation pit 12 and is supported at its ends 20 and 22 by the building structure at about ground level.

A frame 24 surrounds bridge 18 and includes an upper crosshead assembly 26 above the bridge 18, a lower crosshead assembly 28 located below bridge 18 and first and second tie-rod assemblies 30 and 32 which connect the upper and lower crossheads 26 and 28 to one another to complete the frame structure. The frame 24 is moveable up and down in a manner which permits the upper crosshead assembly 26 to be raised and lowered with respect to the top 34 of bridge 18.

A plurality of return cylinders 38 extend between the top 34 of bridge 18 and upper crosshead assembly 26 for supporting the upper crosshead assembly 26 above a workpiece platen 40. An upward facing bottom die 44 is locatd on platen 40 and a downward facing upper die 46 is secured to upper platen 42. A metal ingot or slab 48 is located between dies 44 and 46 to be compressed therebetween to form an end product having a desired shape and characteristics.

To form the ingot or slab 48 into an end product the pressure in return cylinders 38 is relaxed to bring upper die 46 to bear against ingot 48 upon lowering of frame 24. To provide the necessary forging forces, a plurality of main cylinders 50 located below the bridge 18 and extending between lower crosshead assembly 28 and the bottom of bridge 18 are actuated to push the frame down with great force thereby squeezing and forging the metal ingot between dies 44 and 46.

There are more main cylinders 50 than there are return cylinders 38 and each of the main cylinders is larger in size and capacity since the forging forces are far greater than the forces required to merely raise or lower frame 24.

As seen in FIG. 2, upper crosshead assembly 26 is surrounded by a yoke-shaped coupling 52 which includes a top member 54, a bottom member 56 and coupling legs 58 which connect the top member and the bottom member to one another. An identical second coupling member 60 oriented upside down is fitted around lower crosshead assembly 28.

Tie-rod assembly 62 is a particular embodiment for tie-rod assembly 30 shown schematically in FIG. 1. It has left and right sections 64, 66, each of which consists of a lamination of superposed steel plates or bars such as bars 30 in FIG. 1. Each of the bars 30 is connected to bottom member 56 of both crosshead assemblies 26 and 28. Link pins 68 connect bars 30 to bottom members 56. For reference, FIG. 2 depicts bridge 18 as well as several return cylinders 38 and main cylinders 50.

The focus of the present invention is on a particular embodiment of a tie-rod plate or bar as illustrated in FIG. 3. The novel tie-rod plate 70 includes a middle section 72 and first and second end sections 74 and 76 welded to middle section 72 at weld seams 78 and 80. End sections 74 and 76 have an increased width section through which a link pin hole 82 or 84 is formed for receiving a tie, link pin or the like by which the tie-rod bars can be connected to one another and to frame 24.

Middle section 72 is subjected to relatively lower stresses and therefore can be made of less costly alloys. For example an alloy known in the industry as ASTM 572, Grades 45-50, having a yield strength of a minimum of 45,000 psi is recommended. The ends section 74, 76, which are subjected to much larger stresses, can be made, for example, of an alloy steel, for instance the alloy known as ASTM 543-79a, Class 3, which is heat treated to provide a minimum yield strength of 80,000 psi. Weld seams 78 and 80 will actually have a strength which is above that of middle section 72 due to the diffusion of some of the alloying elements from end sections into the weld seam.

An appreciation of the usefulness of the tie-rod plate 70 described above, is gained from a description of the environment in which this plate will be used. Thus, an actual tie-rod plate embodiment for a large forgoing press will have a middle section several inches in thickness, approximately six feet wide and 50–80 feet long. The length to width ratio can range between 8.3 to 14.4. A single bar will weigh about eight and a half tons. Each of the end sections will be approximately 15 feet long, 88 inches wide, and will have a weight of approximately 16 tons. The entire weight of the plate illustrated in FIG. 3 is approximately 49 tons. The link pin hole 84 is approximately 36 inches in diameter. However, for proper strength the relationship $2a>b$, in FIG. 3, should be observed.

A forging press (50–500 kilotons) will use 88 plates 70 in each of its tie-rod assemblies. Thus, the simplification, advantages and benefits provided by each bar 70 is multiplied accordingly to significantly reduce the overall cost and weight of the frame for the forging press.

Although the present invention has been described in connection with a specific embodiment thereof, many other variations, modifications and other uses will now become apparent to those skilled in the art. It is preferred, therefore, that the present invention be limited not by the specific embodiment disclosed herein, but only by the appended claims.

What is claimed is:

1. An improved tie-rod plate in combination with a frame for a large forging press, comprising:

the frame for the large forging press which includes:

a load opposing, horizontally extending, elongated upper crosshead assembly having first and second longitudinally opposed end regions;

a load opposing lower crosshead assembly having its respective first and second end regions which are located on opposite longitudinal ends of said assembly, said lower crosshead assembly being spaced from, parallel to, and coextensive with said upper crosshead assembly, said crosshead assemblies being comprised of pluralities of superposed plates;

first and second tie-rod assemblies for completing said frame, said first tie-rod assembly including a plurality of superposed plates which extend generally vertically between said first end regions of said upper and lower crosshead assemblies and said second tie-rod assembly including a plurality of superposed plates which extend between the second end regions of said upper and lower crosshead assemblies, the respective ends of the plates of said tie-rod assemblies being interleaved with plates which comprise said upper and lower crossheads, a respective link pin through each one of said end regions connecting the tie-rod plates and the crosshead plates to one another;

each plate of said tie-rod assemblies being constituted of the improved tie-rod plate which comprises:

an elongate, single piece, generally flat steel bar which includes a middle section constructed of metal having a predetermined yield strength and first and second end sections welded to longitudinally opposite ends of the middle section and constructed of an alloy steel having a yield strength which is greater than said yield strength of said middle section, each one of said end sections having at least one respective pin hole formed therein for connecting said tie-rod plate in said frame.

2. A tie-rod beam plate as in claim 1 in which said predetermined yield strength of said middle section is greater than 45,000 psi.

3. A tie-rod beam plate as in claim 2 in which said yield strength of said end section has minimal value of 80,000 psi.

4. A tie-rod beam plate as in claim 3 in which said end sections comprise an increased width section in which said pin hole is formed.

5. A tie-rod beam plate as in claim 4 in which said middle section is constructed of a plate having length and width dimensions wherein the ratio of the length to the width ranges between 8.3 to 14.4, the length ranging from 50 to 80 feet.

6. A tie-rod beam plate as in claim 4, in which said middle section comprises ASTM 572 steel alloy selected from grade group 45 and 50.

7. A tie-rod beam plate as in claim 4, in which each of said end sections comprises ASTM 543-79a9 steel alloy which is heat treated to provide said minimum of 80,000 psi yield strength.

* * * * *